US005567172A

United States Patent [19]

Thibault et al.

[11] Patent Number: 5,567,172

[45] Date of Patent: Oct. 22, 1996

[54] UNIVERSAL STRAIN RELIEF DEVICE FOR CONNECTORS

[75] Inventors: William C. Thibault, Powder Springs; Lawrence A. Tinker, Woodstock, both of Ga.

[73] Assignee: AER Energy Resources, Inc., Atlanta, Ga.

[21] Appl. No.: 312,566

[22] Filed: Sep. 26, 1994

[51] Int. Cl.[6] ..... H01R 13/62

[52] U.S. Cl. ..... 439/371; 439/369; 439/668

[58] Field of Search ..... 439/369, 370, 439/371, 502, 449, 451, 668

[56] References Cited

U.S. PATENT DOCUMENTS

| | | | |
|---|---|---|---|
| 3,960,432 | 6/1976 | Wilbur | 439/371 X |
| 4,484,185 | 11/1984 | Graves | 439/371 X |
| 4,514,026 | 4/1985 | Herbert | 439/371 X |

OTHER PUBLICATIONS

Five catalog pages showing various connectors Miniature Ribbon Connectors (CHAMP); RF Coaxial Connectors; Standard Dual–Crimp Bulkhead BNC Jacks; RF Coaxial Connectors; AMP Modular Connectors.

*Primary Examiner*—Khiem Nguyen
*Attorney, Agent, or Firm*—Jones & Askew

[57] ABSTRACT

A protective system for multi-part connections that prevents unintended disconnection, is inexpensive, and can be used regardless of the shape of the connectors which form the connection. The protective system allows interchanging of component connectors without compromising the protective function. The secured connection includes a first connector, a second connector shaped to engage the first connector and including a catch positioned to be accessible when the connectors are engaged, and a securing line shaped at a first end thereof to engage the first connector and at a second end thereof to be secured in the catch.

6 Claims, 2 Drawing Sheets

UNIVERSAL STRAIN RELIEF DEVICE FOR CONNECTORS

TECHNICAL FIELD

The present invention relates to securing connectors of the electrical or mechanical type, and more particularly relates to a device for preventing disconnection of and strain relief for two-part connections.

BACKGROUND ART

Many electrical and mechanical connections are formed by two connectors which press or slide together. As a result, they may subject to becoming disconnected if they are vibrated or bumped. To solve this problem, locking connectors have been provided, but addition of a locking feature may be expensive.

In many situations, disconnection of connectors can have negative consequences. For example, if a portable computer is connected to an external battery, loss of power can result in a loss of valuable data. One type of electrical connection that is often used with cellular telephones and laptop computers is the "cigarette lighter" type consisting of a cylindrical socket and an elongate mating plug. Typically both the socket and the plug are mounted on the end of cables, so that when connected they are still free to move about. Users have found that the plug tends to "back out" of the socket until electrical contact is broken. Providing a locking device for such a connection has been very difficult because, even though the actual socket and inserted end of the plug have a standard configuration, the connectors as a whole are made in a wide variety of different shapes.

Thus, there is a need for an inexpensive device for preventing unintended disconnection of connectors. There is also a need for such a device that can be utilized with a wide variety of connectors of differing shapes, and is effective when one of the connectors of a particular connection is replaced with a substitute connector having a different shape.

SUMMARY OF THE INVENTION

The present invention solves the above-described problems in the art by providing a protective system for multipart connections that prevents unintended disconnection, is inexpensive, and can be used regardless of the shape of the connectors which form the connection. The protective system allows interchanging of component connectors without compromising the protective function.

Generally described, the present invention provides a secured connection, comprising a first connector; a second connector shaped to engage the first connector and including a catch positioned to be accessible when the connectors are engaged; and a securing line shaped at a first end thereof to engage the first connector and at a second end thereof to be secured in the catch. Preferably, tension is applied to the securing line when the second end of the line is secured in the catch, to urge the connectors together.

The securing line may preferably comprise a beaded wire defining a noose at the first end, and the catch may comprise a slot in an outwardly extending flange sized to receive the wire between beads positioned along the wire. In a preferred embodiment, a second catch may be positioned on the second connector, and the securing line may be shaped at the second end to be secured in both the catches.

Several types of combinations of securing line and catch may be utilized. For example, the securing line may be a beaded wire with a wrap member at the first end of the first connector, the wrap member including a releasable fastener capable of holding the wrap member in position around the first connector. In this combination, the catch may be a slot as described above. Or, the securing line may comprise a compressible cord, and the catch may comprise a slot sized to receive and grip the cord. Or, the securing line may comprise a perforated strip, and the catch may comprise a post sized to enter any of a plurality of perforations positioned along the strip. Or, the securing line may comprise a notched strip, and the catch may comprise a slot sized to receive the strip in any of a plurality of notches positioned along the strip.

The present invention is particularly suited to securing a plug in a socket, for example a free-standing "cigarette lighter" socket and mating plug. Although plugs compatible with such a socket are made with a wide variety finger grip shapes, a securing line according to the present invention can be used with any plug shape if the socket is provided with a catch compatible with the securing line. The securing line can be engaged with a plug by forming a noose around the plug, forming a noose around a cable or wire leading into the plug, by tightly wrapping a wrap member around the plug, or by some other fastening method. A catch can be provided on the plug as well as on the socket, but this arrangement requires a specially formed plug, which is not the case with many embodiments of the invention.

Thus, it is an object of the present invention to provide an improved protective system for preventing unintended disconnection of connectors.

It is a further object of the present invention to provide an apparatus for securing a plug within a socket.

It is a further object of the present invention to provide a securing system for a connection that remains operative when one of the connectors is replaced with a connector of a different shape.

Other objects, features and advantages of the present invention will become apparent upon review of the following detailed description of preferred embodiments of the invention when taken in conjunction with the drawings.

DETAILED DESCRIPTION

Figure 10:
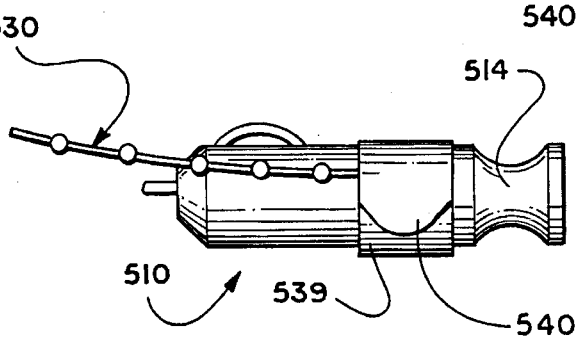
FIG. 10 is a side plan view of a connector plug to which has been secured the securing line of FIG. 9.

Referring now in more detail to the drawings, in which like numerals refer to like parts throughout the several views, FIGS. 1–3 and 7 show a first embodiment of a connection system 10 constructed according to the present invention. The system 10 includes a cylindrical socket 12 and a cylindrical plug 14, which defines a throat portion 16 of reduced diameter, ribbed for gripping with the fingers. Wires 18 extend from conventional contacts within the plug 14 (such as shown in FIG. 10) and out the end of the plug opposite to the socket 12.

Figure 1:
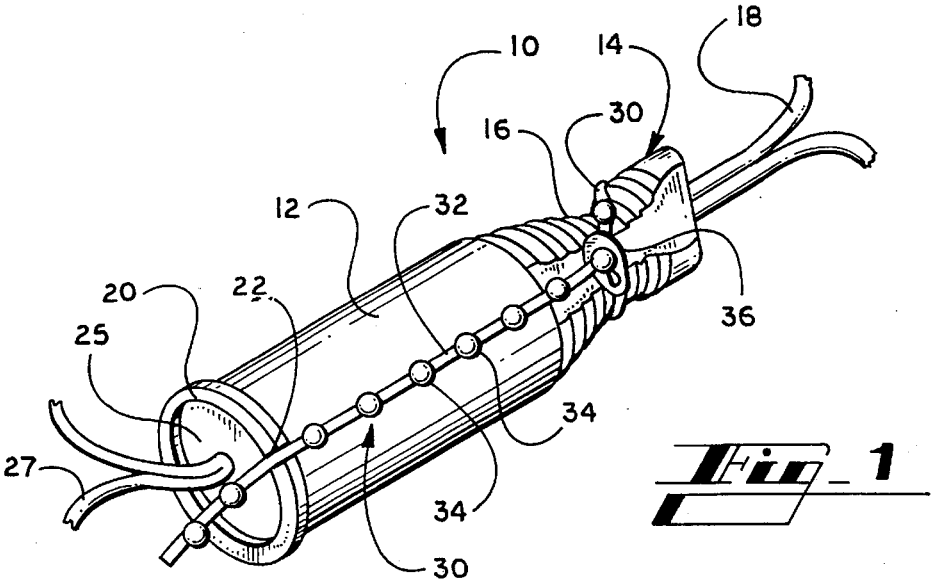
FIG. 1 is a pictorial view of a connection system embodying the present invention.
Figure 2:
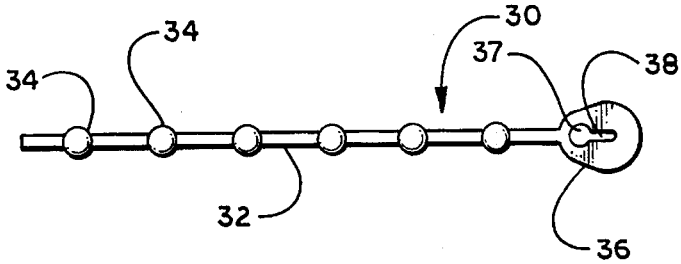
FIG. 2 is a plan view of a securing line used in the system of FIG. 1.
Figure 3:
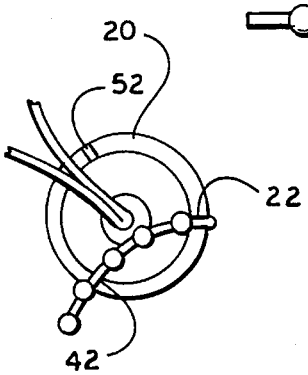
FIG. 3 is an end view of the socket of the connection system of FIG. 1.
Figure 7:
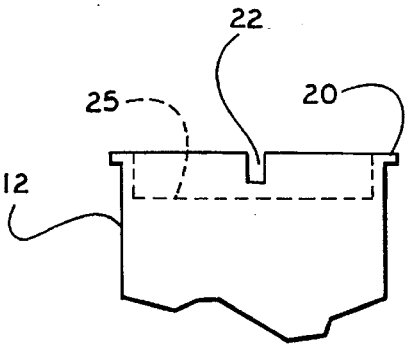
FIG. 7 is a side plan view of the end of a socket defining a catch slot as used in the first embodiment of FIG. 1.

Those skilled in the art will recognize the plug and socket of FIG. 1 as being of the type known as a "cigarette lighter" connection, which is often used to connect electronic devices, such as cellular telephones and portable computers, to batteries. The socket 12 defines a circular flange 20 at the base end of the socket opposite the plug 14. The flange 20 includes a straight slot 22 extending axially into the flange and entirely across its width. FIG. 7 shows a plan view through the slot 22. A second slot 42 and a third slot 52 may optionally be formed in the flange 20, spaced around the flange about 120° from the slot 22, as shown in FIG. 3. The flange also creates a recessed end surface 25 of the socket 12. Wires 27 extend from conventional contacts (not shown) within the socket and out the recessed end 25.

A securing line 30 is installed to urge the plug 14 and socket 12 together. The line 30 in the embodiment of FIG. 1 is a conventional beaded wire formed of a resilient, but strong plastic such as polyethylene, polypropylene, nylon, vinyl, or an elastomer. A central wire 32 connects a series of spaced apart spherical beads 34, and at one end of the beaded wire an eyelet 36 is integrally formed. The eyelet 36 defines a keyhole slot including a circular opening 37 through which the beads 34 can pass, connected to a narrow slot 38 through which the beads cannot pass. However, it will be understood from the following discussion that the securing line 30 can function without the slot 38.

The securing line 30 is installed as shown in FIG. 1 by first forming a noose or lasso in the line 30. This is done by inserting the plain end of the line through the opening 37 in the eyelet 36. The loop thus formed is slipped over the plug 14 before insertion into the socket 12, and the loop is tightened around the throat 16 of the plug. After insertion of the plug 14 into the socket 12, the securing line 30 is stretched along the side of the socket, and the central wire 32 between two of the beads 34 is pressed into the slot 22 at the end of the socket 12. One of the beads 34 engages the wall of the flange 20 within the recessed end 25 of the socket, as shown in FIG. 3. The slot 22 thus forms a catch for securing an end of the line 30. The stretching of the line 30 causes tension to be formed in the line, which is secured to the plug by the noose surrounding the plug and to the socket in the slot 22. A resilient line will put spring force on the connectors, urging the plug and socket together. On the other hand, a non-stretchable line will be drawn taut to keep the connectors from separating.

To make the securing of the line 30 to the socket more firm, the line 30 may be extended across the base of the socket and pressed into one of the other slots, 42 or 52, as also shown in FIG. 3. The slots are formed to a width slightly less than the diameter of the central wire 32, so that a secure press fit is obtained. More slots may be provided around the flange if desired, so that the beaded wire 30 extending from the noose along the socket is always convenient to a slot. In this case the plug does not have to be twisted to align the beaded wire 30 with a slot.

Figure 4:
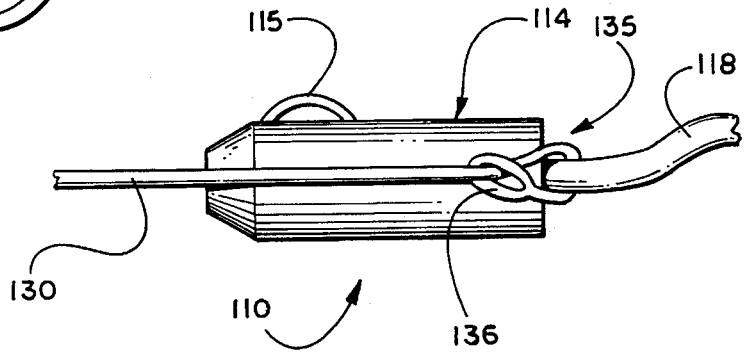
FIG. 4 is a side plan view of parts of a second embodiment of a connection system according to the invention.

It should be noted that the noose arrangement for engaging the plug 14 provides a universal system suitable for all types of plugs. FIG. 4 shows a smooth-sided plug 114 having an electrical contact 115 and a cable 118 extending from the plug. As the plug has no throat portion 16, the noose is tightened around the cable 118 and does not slip along the smooth surface of the plug, as shown in FIG. 4.

Figure 5:
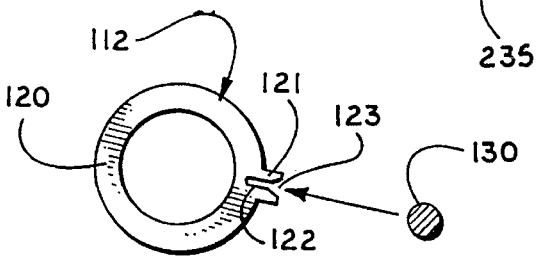
FIG. 5 is an end view of a socket used with the plug and securing line shown in FIG. 4.

FIG. 4 show a second embodiment of a connection system 110 constructed according to the present invention. In this embodiment, a securing line 130 is formed of a braided cord, plastic foam string, or other deformable cord. A loop 136 is formed at one end of the cord. A socket 112, shown in FIG. 5, includes a flange 120 in which is formed a radially extending tab 121 defining a gripping slot 122 which opens radially outwardly at a V-shaped opening 123. As in the previous embodiment, a noose 135 is formed in the cord and tightened around the cable 118. The cord is then stretched along the socket and pressed into the gripping slot 122 to secure the plug 114 to the socket 112.

Figure 6:
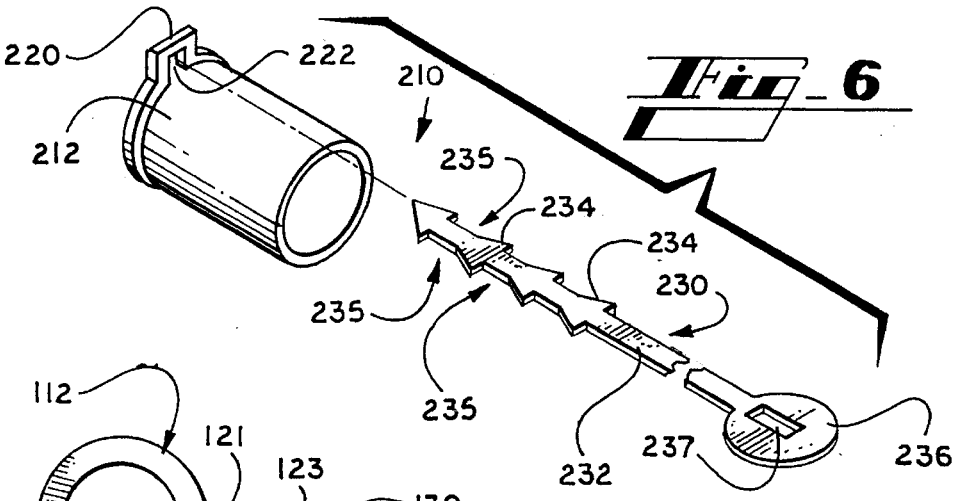
FIG. 6 is a pictorial view of parts of a third embodiment of a connection system according to the invention.

A third embodiment of a connection system 210 constructed according to the present invention is shown in FIG. 6. A socket 212 includes an outwardly extending tab 220 in which is formed a catch opening 222. The tab and catch opening are shown to be rectangular in shape, but other shapes may be used. A securing line 230 for this embodiment resembles plastic locking "ties" supplied with garbage bags and the like. A flat plastic strip 232 defines pairs of teeth 234 spaced along both sides of the strip 232. Thus, notches 235 are formed on both sides of the strip between successive, pairs of teeth 234. At one end of the strip, an eyelet 236 is formed defining an elongate slot 237 through which the toothed strip may pass in one orientation, but which traps the teeth when they are turned transverse to the length of the slot 237.

To engage the securing line 230 to a plug connector, a noose is formed and placed about the plug in the manner shown in FIG. 1 or FIG. 4. After the plug is inserted into the socket 212, the toothed strip 232 is inserted through the opening 222 of the socket 212 and pulled through until taut. The teeth 234 then prevent the strip 232 from being removed from the opening 222 and the plug and socket are held together. Preferably, the catch opening 222 is shaped similarly to the slot 237, with a long dimension through which the teeth may be passed, and a transverse dimension which blocks passage of the teeth. Or, the teeth may be forcibly folded to pass them through the opening 222.

Figure 8:
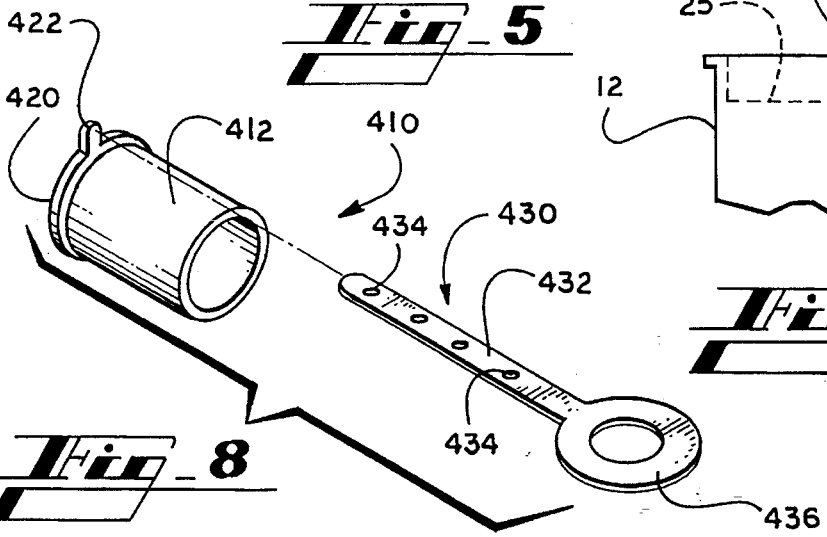
FIG. 8 is a pictorial view of parts of a fourth embodiment of a connection system according to the invention.

A fourth embodiment of a connection system 410 constructed according to the present invention is shown in FIG. 8. A socket 412 includes a post 422 extending outwardly from a flange 420, although the post could be located anywhere on the socket 412. A securing line 430 includes a perforated flat plastic strip 432 which terminates at one end in an eyelet 436. A plurality of spaced apart perforations 434 are formed through the strip 432. A noose may be formed in the line 430 in a manner described above for engagement with a plug. After the plug is inserted into the socket 412, the line 430 is stretched along the socket, and one of the perforations 434 is placed onto the post 422 to secure the plug to the socket.

Figure 9:
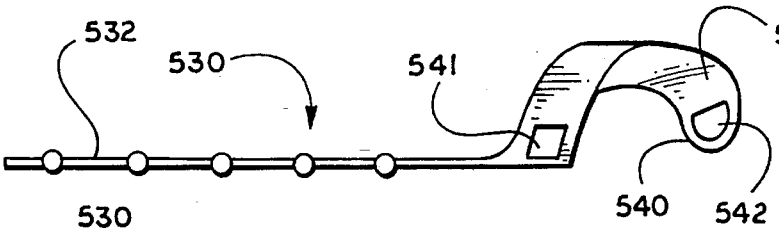
FIG. 9 is a pictorial view of a securing line used with a fifth embodiment of a connection system according to the invention.

A fifth embodiment of a connection system 510 constructed according to the present invention is shown in FIGS. 9 and 10. A securing line 530 includes a beaded wire 532 which can engage a slot in a socket in the manner described in connection with the embodiment of FIG. 1. At one end of the beaded wire 532 a wrap tag 539 extends from the wire. The wrap tag can be formed integrally with the wire from thin, flexible plastic, or can be attached to the wire. The tag 539 has a length sufficient to wrap around typical plugs. One part 541 of a two-part fastener (shown as patches of a hook-and-loop fastener) is secured to one surface of the tag 539 adjacent to the attachment of the tag to the beaded wire 532. The other part 542 of the fastener is secured to the other surface of the tag adjacent to an opposite end 540 of the tag 539. Other two-part fasteners such as snaps, hook-and-eyelet, or others, could be used.

The wrap tag 539 is wrapped around the body of a plug 514 as shown in FIG. 10, and the parts 541 and 542 of the fastener are engaged to secure the tag and line 530 to the plug. The beaded wire 530 can then be engaged with a catch on a socket.

Those skilled in the art should understand that many variations to the above-described embodiments are possible. For example, the catch on the socket need not be positioned at the base of the socket as shown, but may be positioned along the side of the socket, or at any suitable position on a different type of connector. Also, additional parts of a connection, such as an adapter, can be inserted between the plug and socket. In such a case, the securing line will hold all the the parts together. Furthermore, it should be understood that the present invention is applicable to a wide variety of types of connections in addition to the "cigarette lighter" type shown.

From the foregoing description, it will be seen that the protective system of the present invention is simple to manufacture, is inexpensive, and has universal applicability to a wide variety of connector shapes.

The foregoing relates only to the preferred embodiments of the present invention, and many changes may be made therein without departing from the scope of the invention as defined by the following claims.

What is claimed is:

1. A secured electrical connection, comprising:

a first male connector;

a second female connector shaped to receive said first connector within a sleeve defined by said second connector;

one of said first and second connectors defining a projection including a catch positioned to be accessible when said connectors are engaged; and an elastic, beaded securing line defining an opening at a first end thereof to enable formation of a loop in said securing line;

a bead of said securing line being trapped in said catch of said one connector, and said loop engaging said other connector, such that said elastic securing line is held in tension.

2. The apparatus of claim 1, further comprising a second catch positioned on said one connector, another bead of said securing line being trapped in said second catch.

3. The apparatus of claim 1, wherein said projection comprises an outwardly extending flange and wherein said catch comprises an open slot defined in said flange.

4. The apparatus of claim 3, wherein said first connector comprises a cigarette lighter style plug and said second connector comprises a cylindrical socket.

5. A secured electrical connection, comprising:

a first male connector;

a second female connector shaped to receive said first connector within a sleeve defined by said second connector;

one of said first and second connectors defining a projection including a catch positioned to be accessible when said connectors are engaged; and an elastic, beaded securing line including a wrap member at a first end thereof, said wrap member including a releasable fastener;

a bead of said securing line being trapped in said catch of said one connector, and said releasable fastener holding said wrap member in position around said other connector, such that said elastic securing line is held in tension.

6. The apparatus of claim 1, wherein said opening in said first end of said securing line is a keyhole-shaped opening sized to selectively pass or trap said beads of said securing line.

* * * * *